US012741791B2

(12) United States Patent
Casanova

(10) Patent No.: US 12,741,791 B2
(45) Date of Patent: Sep. 22, 2026

(54) "BAR HELPER" OR "TOPPER"

(71) Applicant: Christian Francis Casanova, Tucson, AZ (US)

(72) Inventor: Christian Francis Casanova, Tucson, AZ (US)

( * ) Notice: Subject to any disclaimer, the term of this patent is extended or adjusted under 35 U.S.C. 154(b) by 0 days.

(21) Appl. No.: 18/445,953

(22) Filed: Apr. 15, 2024

(65) Prior Publication Data

US 2025/0178799 A1 Jun. 5, 2025

Related U.S. Application Data

(60) Provisional application No. 63/577,823, filed on May 26, 2023.

(51) Int. Cl.
*B65D 47/06* (2006.01)

(52) U.S. Cl.
CPC ..... *B65D 47/06* (2013.01); *B65D 2547/066* (2013.01)

(58) Field of Classification Search
CPC ..... B65D 47/06; B65D 2547/066
See application file for complete search history.

(56) References Cited

U.S. PATENT DOCUMENTS 22,370 A * 12/1858 Lewis ..... B65D 39/06 222/500
221,091 A * 10/1879 Newton ..... B65D 47/242 222/519
1,983,101 A * 12/1934 Seribner ..... F16N 3/04 222/481
5,211,318 A * 5/1993 Govatzidakis ..... B65D 47/06 222/533
6,230,944 B1 * 5/2001 Castellano ..... B65D 47/243 222/481.5
6,523,720 B1 * 2/2003 Robbins, III ..... B65D 1/0246 222/481.5
6,742,678 B1 * 6/2004 Krystopik, Jr. ..... B65D 47/122 222/481.5
8,205,541 B2 * 6/2012 Barberio ..... B67D 3/0051 99/323.1
8,944,297 B2 * 2/2015 Agassi ..... B65D 47/12 222/481.5
2005/0184026 A1 * 8/2005 Haley ..... B65D 47/32 222/484
2006/0000855 A1 * 1/2006 Allen ..... B65D 47/06 222/484
2008/0073383 A1 * 3/2008 McDonald ..... B65D 49/04 222/500
2024/0034521 A1 * 2/2024 Starkenburg ..... B65D 25/48

* cited by examiner

*Primary Examiner* — Vishal Pancholi

(57) ABSTRACT

A protective assembly for a metal alcohol pour spout includes a flexible sleeve configured to fit over at least a portion of the pour spout and a top piece configured to be retained within the sleeve. The sleeve includes an interior ridge and a reduced-diameter upper opening. The top piece is sized to fit into the upper opening and is retained by the interior ridge. The sleeve and the top piece together cover exposed metal portions of the pour spout to reduce contact with exposed edges during handling and use.

3 Claims, 5 Drawing Sheets

"BAR HELPER" OR "TOPPER"

(B) CROSS-REFERENCE TO RELATED APPLICATION

This application is related to U.S. utility patent application Ser. No. 18/445,953 filed Apr. 15, 2024 the disclosure of which is incorporated Herein by reference to the extent permitted for non-provisional patent Application.

(C) STATEMENT REGARDING FEDERALLY SPONSORED R&D

Not applicable

(D) THE NAMES OF PARTIES TO A JOINT RESEARCH AGREEMENT

Not applicable

(E) REFERENCE TO A "SEQUENCE LISTING" A TABLE OR A COMPUTER PROGRAM

Not applicable

(G) BACKGROUND OF INVENTION

A problem exists where bartenders scrape the inside of there finger tips on the metal alcohol pour spouts.?

(F) STATEMENT REGARDING PRIOR DISCLOSURES BY AN INVENTOR OR JOINT INVENTOR

Not Applicable

(H) BRIEF DESCRIPTION OF THE SEVERAL VIEWS OF THE DRAWINGS

(I) DEFINITIONS

RIDGE/NIPPLE—As used herein, an internal retaining structure which may be referred to as a ridge/nipple is a protrusion extending inwardly from the interior surface of the sleeve and configured to retain the topper.

(J) ELEMENT DEFONITION

| Number | Element Name |
|---|---|
| 110 | Bar Helper/Topper |
| 120 | Sleeve |
| 122 | Ridge/Nipple |

-continued (J) ELEMENT DEFONITION

| Number | Element Name |
|---|---|
| 124 | Topper piece |
| 212 | Tapered tip |
| 214 | Ridges |
| 216 | Cylindrical body |
| 218 | Tubular body |
| 250 | Metal alcohol pour spout |

(K) DESCRIPTION OF THE INVENTION

This Bar Helper/Topper (110) is configured to be positioned on top of the metal spouts added to alcohol bottles to serve drinks at a bar. The Bar Helper/Topper (110) helps stop scraping the skin off their fingers since it covers that metal tip on the metal alcohol pour spout (250).

It can be made out of different plastics and/or rubber and can be made in multiple colors later down the road A small Two-piece design example, both pieces, stacked on one another, is only 20 mm in length.

Figure 1:
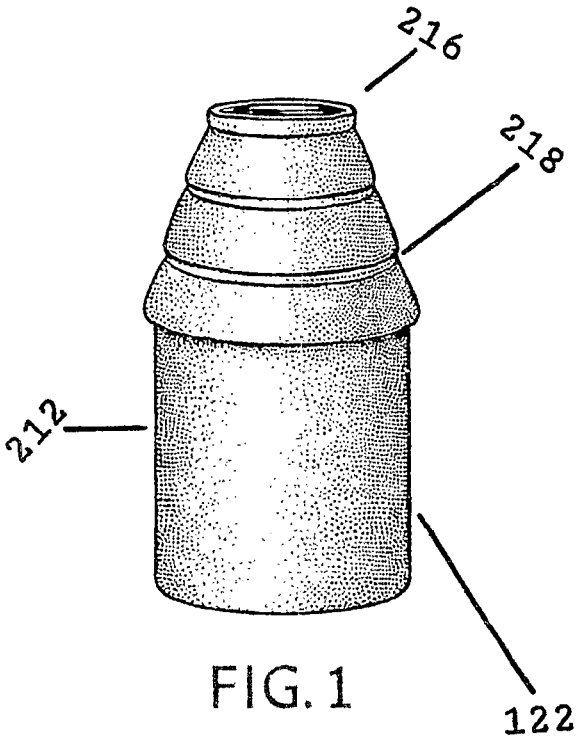
FIG. 1 shows a top piece (112) cylindrical body (114) tapered tip (216) ridges (218)

The top piece (212) has a cylindrical body (214) with 3 ridges (218) leading to the tapered tip (216) consecutively getting smaller to fit the top of a metal alcohol pour spout (250) snuggly. See FIG. 1

Figure 2:
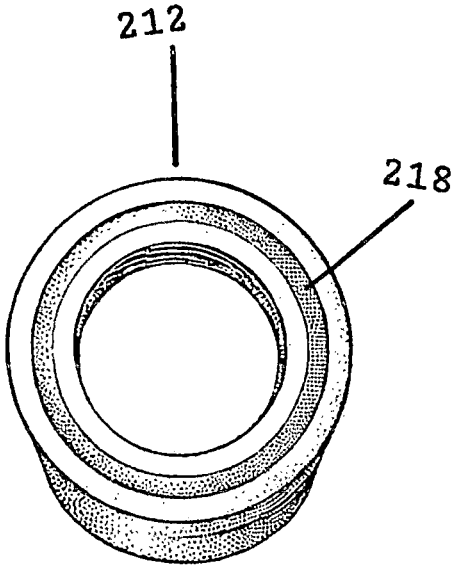
FIG. 2 shows a top view of the top piece (112)

FIG. 2. Is a view from the top looking down at the top piece (212) and viewing the conical shape and ridges (218); it is 6 mm wide and made out of PLA.

Figure 3:
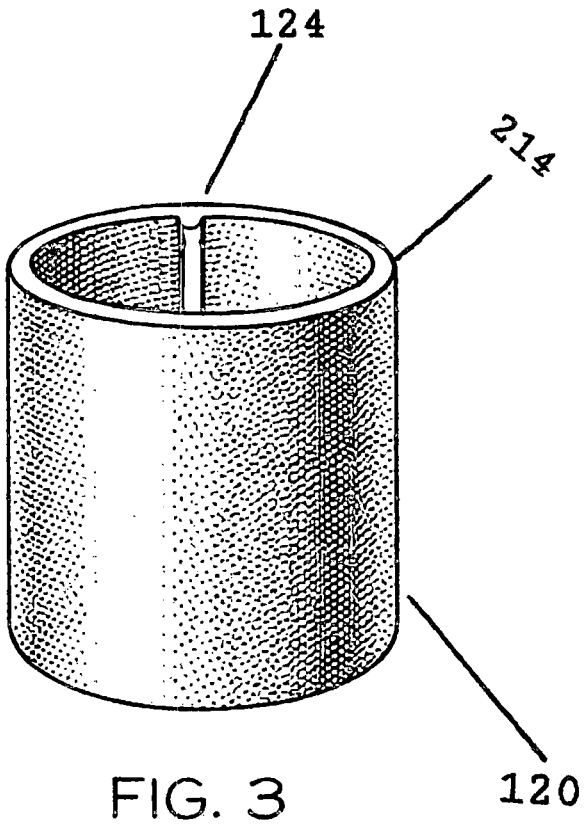
FIG. 3 shows a sleeve (120) with tubular body (220)

The sleeve (120) is the bottom half which slides down the metal alcohol pour spout (250), Inside the sleeve (120) there is an internal retaining structure nipple/ridge (124) which applies pressure to the top piece (212) so that both pieces are secured together, the sleeve (120) it is tapered slightly at the top of the sleeve (120) to apply pressure to create a seal between both pieces. See FIG. 3.

Figure 4:
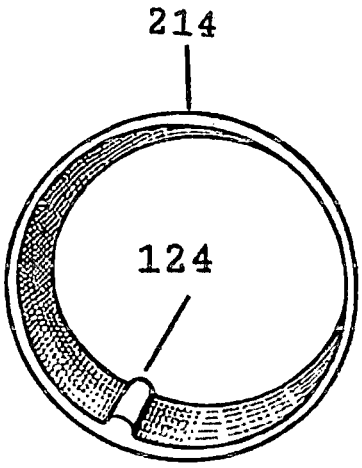
FIG. 4 shows a section view of sleeve (120) Showing the internal retaining structure ridge/nipple (124)

FIG. 4. Is a view of the sleeve (120) and on its side demonstrating the internal retaining structure nipple/ridge (124) running down the inside of the tubular body (122) of the sleeve (120), The internal retaining structure nipple/ridge (124) applies pressure on the top piece to lock both pieces together, once the top piece (212) is inserted.

Figure 5:
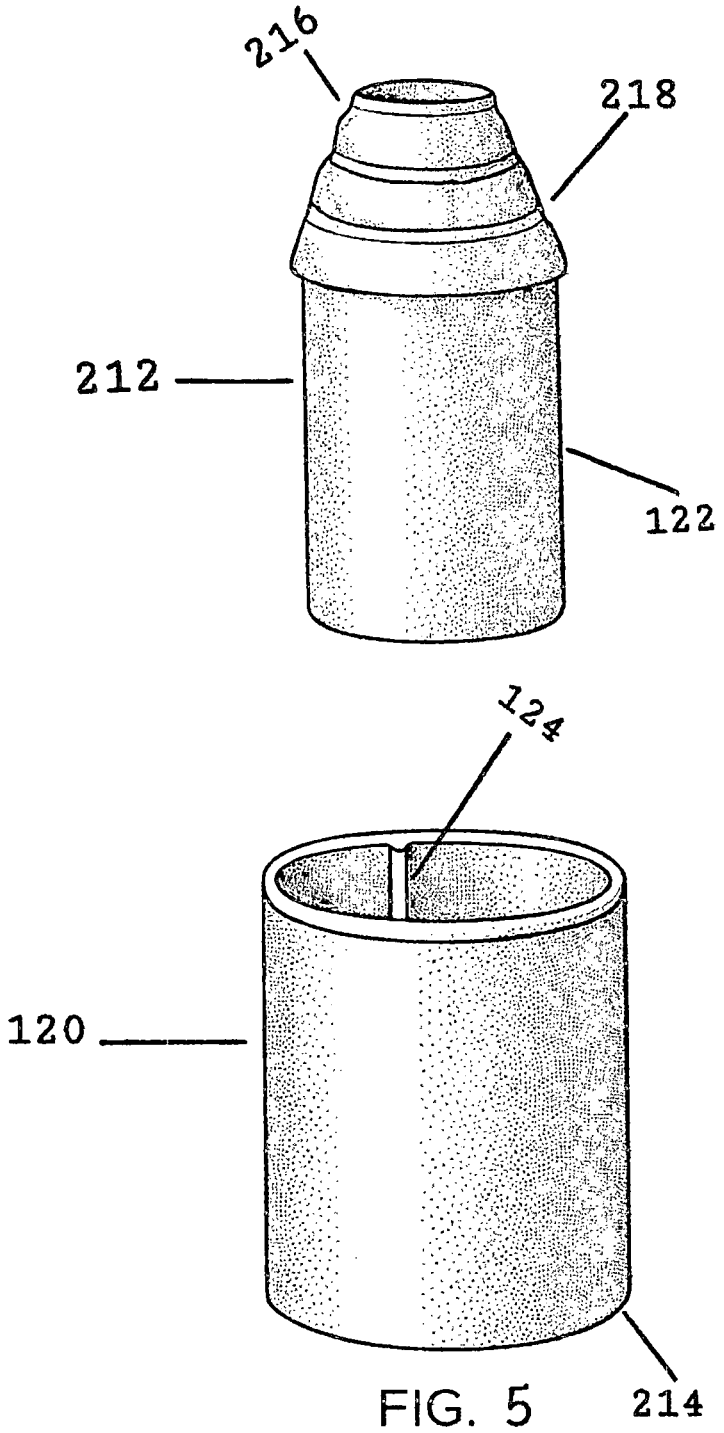
FIG. 5 shows assembly of Bar Helper/Topper (110) sleeve (120) and top piece (212) On a metal alcohol pour spout (250)

FIG. 5. Is a drawing demonstrating the two pieces; 1st top piece (212) which has conical tapered tip (216) with 3 ridges (218), and 2nd the sleeve (120) which is the bottom half demonstrating the internal retaining structure nipple/ridge (124) inside that applies pressure to the Top piece (212) once inserted.

Figure 6:
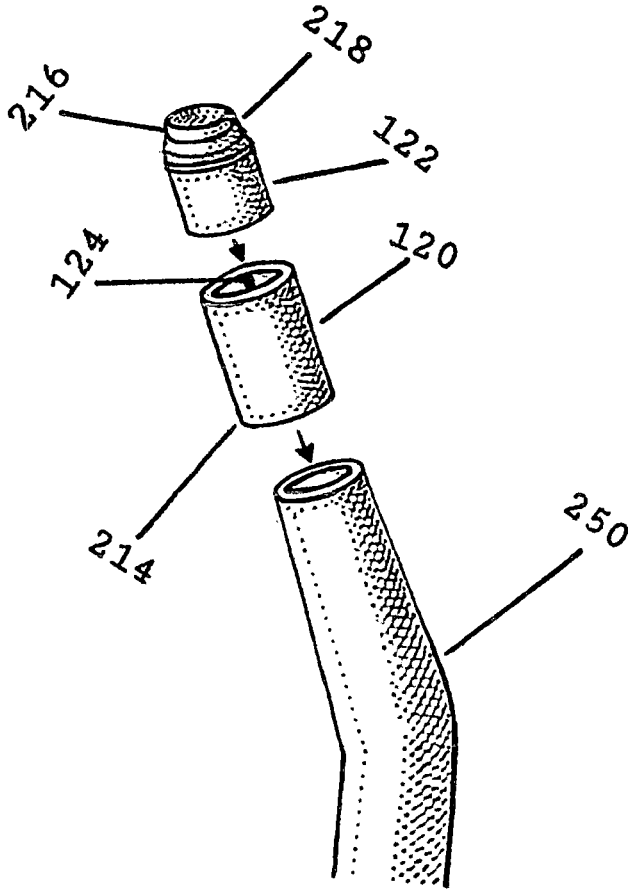
FIG. 6 shows assembly of Bar Helper/Topper (110) on Metal alcohol pour spout (250)

FIG. 6. Is a drawing demonstrating how the two pieces are placed on the metal alcohol pour spout (250) and the order in which they are placed.

Figure 7:
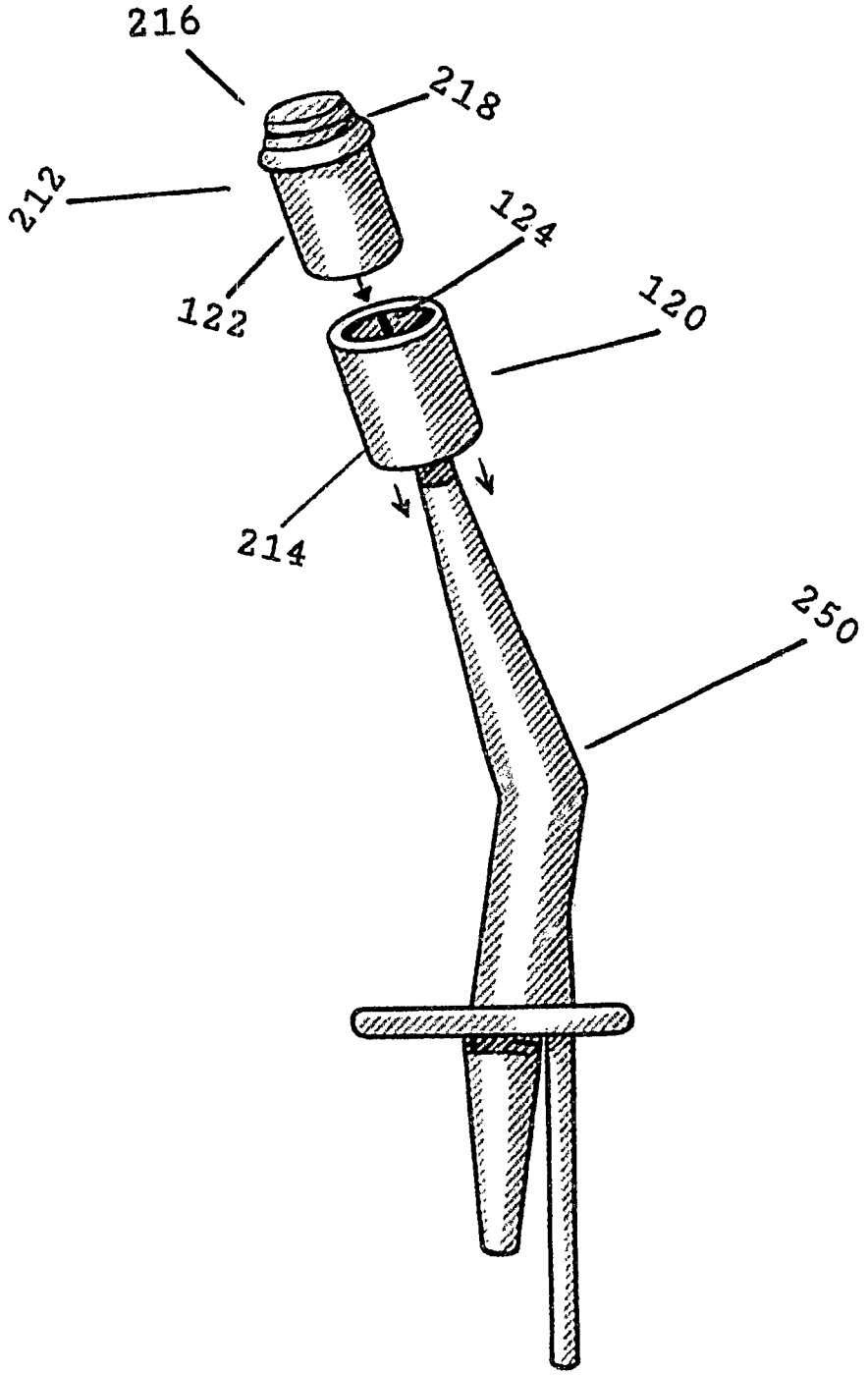
FIG. 7 shows a blow up assembly of Bar Helper/Topper (110) on A metal alcohol pour spout (250)

FIG. 7. Is a drawing of the Top piece (212) and Sleeve (120) demonstrating how the Bar Helper/Topper (110) is applied to a metal alcohol pour spout (250) and in what sequence.

In reference to FIG. 5, the two pieces can be made out of any food grade plastic or a fourm of soft food grade rubber, we will have different colors for different types of alcohol and use other materials. The Top piece (212) goes on the tip of the metal alcohol pour spout (250) and the sleeve (120) is there to lock and secure the top piece (212) on the metal alcohol pour spout (250).

In reference to FIG. 6, the drawing demonstrates how the sleeve (120) slides down first over the metal alcohol pour spout (250) and since the sleeve (120) is bigger at the bottom, there is an internal retaining structure nipple/ridge (124) is inside the sleeve (120) to apply pressure to the top piece (212) that holds it in place since the top of the sleeve (120) is slightly smaller. It closes the gap between the two pieces and secures them both.

In reference to FIG. 7, this drawing demonstrates a metal alcohol pour spout (250), how the two parts come together. The sleeve (120) slides down the metal alcohol pour spout (250), and locks the top piece (212) in place so it does not fall off.

(K) 1 GENERAL CONSIDERATIONS

While the forgoing written description of the invention enables a person having ordinary skill in the art to make and use the invention and describes what is presently considered to be the best mode thereof, those skilled in the art will understand and appreciate that variations, combinations, and equivalent of the specific embodiments, processes and examples described herein may be made without departing from the scope of the invention accordingly, the invention is not limited to the particular embodiments, processes, or examples described above, but rather encompass all embodiments and processes falling within the scope and spirit of the invention as defined by claims.

The inventions shown and described herein may be used to address one or more problems not expressly identified herein and may provide benefits that are not yet fully recognized or appreciated. The descriptions of advantages, objectives, or expected results herein are not intended as admissions that others have recognized or addressed such needs, nor do they limit the scope of the invention. The invention may relate to new and useful improvements and discoveries as recognized under applicable law.

I claim:

1. A protective assembly for a metal alcohol pour spout, comprising;

a flexible sleeve formed of a soft, food-safe rubber material, the sleeve having an open lower end configured to receive and cover at least an upper portion of the metal alcohol pour spout, and a reduced-diameter upper opening;

an interior ridge positioned on an interior surface of the sleeve, configured to retain a top piece sized to fit a clustered, conical upper portion and a cylindrical lower portion, wherein the upper portion comprises a reduced diameter from bottom to top direction, wherein the upper portion further comprises two annular recesses positioned an equal distance from each other, wherein the cylindrical lower portion sits inside the flexible sleeve and abuts the interior ridge.

2. The protective assembly of claim 1, wherein the sleeve and the top piece are color-coded to identify contents associated with metal alcohol pour spout.

3. The protective assembly of claim 1, wherein the sleeve is cylindrical.

* * * * *